United States Patent [19]

Moravek et al.

[11] Patent Number: 4,685,229

[45] Date of Patent: Aug. 11, 1987

[54] AIR CUSHIONED SUPPORT SOLE PLATE

[75] Inventors: Peter Moravek, Oberursel; Bernd Trebitz, Königstein; Albrecht Weller, Steinbach; Klaus Amsel, Oberursel, all of Fed. Rep. of Germany

[73] Assignee: Braun Aktiengesellschaft, Kronberg, Fed. Rep. of Germany

[21] Appl. No.: 865,380

[22] Filed: May 20, 1986

[30] Foreign Application Priority Data

May 22, 1985 [DE] Fed. Rep. of Germany ..... 3518425

[51] Int. Cl.[4] ..... D06F 75/30; D06F 75/38

[52] U.S. Cl. ..... 38/84; 38/93

[58] Field of Search ..... 38/75, 84, 85, 88, 93; 112/DIG. 2; 273/126 R, 128 CS; 219/245, 250

[56] References Cited

U.S. PATENT DOCUMENTS

| | | | |
|---|---|---|---|
| 2,864,185 | 12/1958 | Vance . | |
| 3,870,309 | 3/1975 | Tessler | 273/128 CS |
| 3,992,009 | 11/1976 | Trbovich | 273/126 R |
| 4,233,763 | 11/1980 | McMullen | 38/77.83 |
| 4,524,263 | 6/1985 | Yamac . | |

FOREIGN PATENT DOCUMENTS

| | | | |
|---|---|---|---|
| 476394 | 5/1929 | Fed. Rep. of Germany . | |
| 2224780 | 12/1972 | Fed. Rep. of Germany | 38/84 |
| 48-21008 | 6/1973 | Japan . | |

*Primary Examiner*—Werner H. Schroeder
*Assistant Examiner*—Andrew M. Falik

[57] ABSTRACT

An ironing device which comprises an unheated soleplate, a fan, and a discharge port in the soleplate. The fan generates an air stream which is conveyed via the discharge port between the soleplate and a textile material. A large surface and supporting air cushion is developed between the soleplate and the textile material.

16 Claims, 6 Drawing Figures

AIR CUSHIONED SUPPORT SOLE PLATE

BACKGROUND OF THE INVENTION

The present invention relates to an apparatus for ironing a textile material placed on a base support, with an air stream generated by a fan and directed via a duct to at least one discharge port in a soleplate of an ironing device exiting from said soleplate.

An iron is known from German laid-open print No. 22 24 780 discloses a compressor generating a stream of air. On the bottom side of the iron's sole, discharge ports for the air stream are provided at the edge thereof. The air stream generated by the compressor propagates through ducts in the iron which heat up the air stream. The stream of hot air exiting from the discharge ports is deflected by the textile material placed on the base support, it flows in all directions radially away from the iron and serves to dry and smooth the textile material to be ironed. Hence, the hot air is distributed along the iron's contour. As the hot air streams out of the discharge ports it impinges with high pressure vertically on the textile material to be ironed, simultaneously, there is achieved an effect of the heavy iron being relieved of load due to reduction of the sliding friction, with some contact still being maintained between the iron's sole and the material.

With the relief effect of the iron—due to the air stream exiting vertically downwardly solely from the lateral discharge ports—the contact between the heated iron sole and the textile material being ironed is impaired. That means, the advantage that is possibly gained by the drying effect of the stream of hot air is lessened by the reduced pressure the iron's sole exerts on the textile material. Therefore, the iron disclosed in German laid-open print No. 22 24 780 requires considerably higher quantities of energy for ironing than any conventional iron.

Further, an iron containing discharge ports in the iron's sole is known from Japanese utility model No. 48-21008. Emanating from the discharge ports is hot air which is generated by a heater fan in the interior of the iron. Additionally, said iron is provided with a discharge port for the hot air allowing to use the iron as a hair dryer. This prior-art iron has a very complicated design.

It is therefore an object of the present invention to devise a method and apparatus which permits the ironing process to be carried out in a fashion saving considerably more energy and treating the textile material being ironed more carefully, and which allows to be implemented by virtue of an easily managable device.

SUMMARY OF THE INVENTION

According to the present invention, a method and apparatus is set forth in which the flow path and the accumulated pressure of the air stream beneath the soleplate of an ironing device is such as to develop a supporting large-surface air cushion between the textile material and the soleplate of the ironing device. In an advantageous manner, this air cushion supports the ironing device during the ironing process.

In a particularly preferred embodiment, the soleplate can be cold, i.e. it need not have any heating.

Thus, there is no direct contact with the textile material to iron over the entire soleplate of the ironing device, and there is no energy required to heat the soleplate. Therefore, the ironing process is not performed by contact heat, as in the prior art, but mainly by a convective flow of the supporting air cushion. Hence, the air stream exiting from a discharge port serves to carry the ironing device and to expel the humidity from the textile material. Moreover, it is not necessary to machine the soleplate to be particularly smooth, the sliding friction of the air cushion being considerably less than the sliding friction with which the ironing device abuts on the textile material. The sliding properties of the soleplate are not subjected to greater demands. Besides, there is no fire hazard inherent in the soleplate.

Although the ironing device is hovering on the air cushion, the force of the iron's weight is transmitted via the large-surface air cushion onto the textile material to iron. Thus, the smoothing effect ensuing from the weight of the ironing device will not get lost, and the unfavourable friction between soleplate and textile material is avoided. In order to obtain the largest possible air cushion or air pad, respectively, the air stream is conducted beneath the soleplate through long flow paths. Likewise, the pressure of the air stream is chosen such as to cause sufficient static pressure between the soleplate and the textile material which is enough to lift the ironing device from the textile material by a predefined amount.

According to an advantageous improvement, a stream of hot air or water vapor is used with a thin plastic or metal soleplate.

In an ironing device for implementing the method, the discharge port for the air stream is arranged in the mid-zone of the soleplate. Resulting therefrom are long flow paths for the air stream from the mid-zone up to the edge of the sole-plate. Thereby, a large-surface air cushion will be accomplished over the entire soleplate. Each portion of the air stream will therefore have to cover a specific distance from the mid-zone of the soleplate until it reaches the sole-plate's edge, in consequence whereof the total air stream is exploited for the purpose of devising a drying and supporting air cushion.

A further ironing device to implement the method features the discharge port for the air stream to be arranged at the edge of the soleplate and the direction of flow of the air stream to point underneath the soleplate. Herein, the total air stream is made use of also to support the ironing device. The instant invention does not inhere the shortcoming of the state of the art that large quantities of air are allowed to escape quickly from the soleplate's edge. The supporting effect of the iron caused by the air stream—which is not at all desirable in prior-art irons and has as a result insufficient contact between the heated ironing sole and the textile material—is achieved by the present invention with considerably less fan capacity.

According to a favorable improvement of the ironing devices, the soleplate comprises a marginal bead. By virtue of this marginal bead, a defined space for stowing the air stream is constituted beneath the soleplate, the marginal bead obstructing the discharge of the air stream and contributing to increasing the air cushion effect in the presence of reduced fan capacity.

BRIEF DESCRIPTION OF THE DRAWINGS

Hereinbelow, the present invention will be described in more detail with reference to the accompanying drawings, in which.

DESCRIPTION OF PARTICULAR EMBODIMENTS

Figure 1:
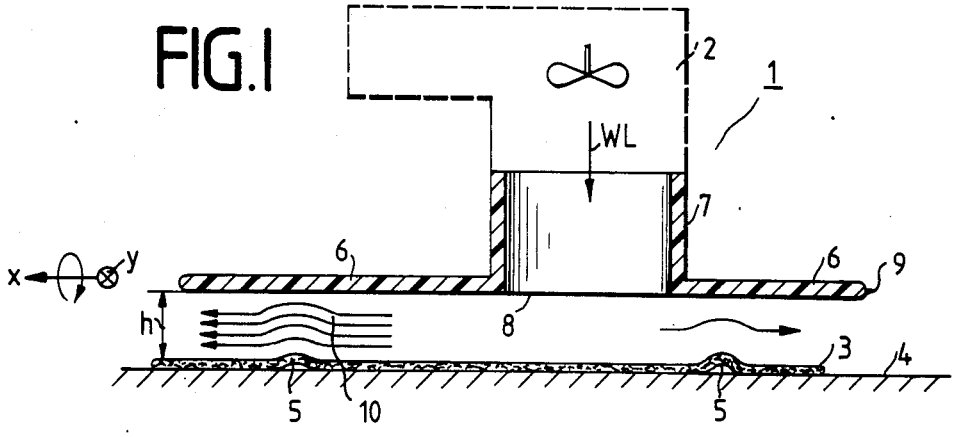
FIG. 1 is a first embodiment of a soleplate according to this invention.

FIG. 1 shows a first embodiment of an ironing device 1 according to the instant invention in longitudinal cross-section. A fan 2 directs an air stream WL to the ironing device 1. Said air stream WL is conveyed through a tube 7 to a discharge port 8 in the soleplate 6.

The discharge port 8 is located in the mid-zone of the soleplate 6. Thus, soleplate 6 extends from the discharge port 8 up to an edge 9 of the soleplate 6.

As can be gathered from FIG. 1, textile material 3 having wrinkles 5 is placed on a base support 4 for ironing. When fan 2 is put into operation, the air stream flows into the tube 7 and is conveyed via the discharge port 8 intermediate the soleplate 6 and the textile material 3 to iron. The pressure and the quantity of the air stream WL generated by the fan 2 are chosen such that the air stream WL has sufficient energy to produce those forces which lift the ironing device 1 from the textile material by a predetermined amount 'h'. Thus, the air stream WL is forced in all directions inbetween the soleplate 6 and the textile material 3 and thereby forms a supporting air cushion 10 for the ironing device 1. That means, the ironing device 1 is supported by the constantly prevailing air stream WL which forms the air cushion 10. Further, the air stream flows from the discharge port 8 in parallel to the textile material 3 off beyond the edge of the soleplate 6.

In FIG. 1, the air cushion 10 is illustrated in the form of flow lines which exert forces on the wrinkles 5 of the textile material 3 and remove these wrinkles 5. Likewise, the flowing air cushion 10 absorbs the moisture contained in the textile material 3 and transports this moisture away from a large zone extending beyond the surface of the soleplate 6. Since the discharge port 8 is arranged in the mid-zone of the sole-plate 6, there result long discharge paths for the air stream WL, so that the flowing air cushion 10 has ample time to absorb the moisture in the textile material 3, that is to expel it therefrom. The weight of the ironing device 1 is transmitted via the air cushion 10 on the textile material 3 to iron in the same fashion as if the soleplate 6 were bearing directly on the textile material 3 like in conventional ironing processes. The smoothing effect of the ironing device 1 is hence achieved via the soleplate 6 and the air cushion 10 disposed in front thereof which aids in removing wrinkles 5. An essential advantage of the ironing device 1 hovered on the air cushion 10 or air pad, respectively, reside in that there occurs no friction at all between the soleplate 6 and the textile material 3. The shortcomings that in known ironing processes the textile material becomes worn off or gets glazed points due to friction or the high contact pressure are overcome by the present invention. Moreover, the bottom side of the soleplate 6 is not required to afford great sliding properties like in conventional ironing soles of irons. Therefore, manufacture of the soleplate 6 is considerably simpler and cheaper than that experienced with a conventional iron. In addition, the ironing device 1 is more easily displaced over the material because of the lower friction between the air cushion 10 and said material. The fact that the sole plate isn't heated is an energy saving feature.

Depending on the case of application, the air stream WL is cold or heated. It is an advantage, however, if the fan 2 is a hot-air fan. Owing to the absence of any heating in the soleplate 6, its manufacture is additionally simplified. In case of need, the air stream WL and more particularly if said is a hot air stream, may contain water vapor which serves for steaming in a manner heretofore known. Steam, water or moisture can also be delivered to non-illustrated jets in the soleplate 6. Further, it is possible to inject the steam in the fan 2 or in the area of the tube 7, whatever demand may be.

The discharge port 8 is placed in a position in the soleplate 6 at which the forces which the air cushion 10 exerts on the soleplate 6 counteract those tilting moments which, in respect of the discharge port 8 as point of rotation, emanate from the ironing device 1. That means, the fan 2 indicated in FIG. 1 will tilt the ironing device 1 counterclockwise in consequence of the weight portions projecting to the left. To balance this, the front part of the soleplate 6 is considerably longer than the rear one. Thus, the front part of the soleplate surface acts as a considerably longer lever than the rear part. The forces originating from the air cushion 10 and acting on the front part of the sole-plate 6 neutralize the tilting moment turning counterclockwise that is caused by the fan 2. Therefore, the discharge port 8 is preferably arranged on the longitudinal axis (x-axis) of the soleplate 6. Likewise, the discharge port 8, in cross direction of the soleplate 6, is placed in a position such that the tilting moments about the longitudinal axis of the soleplate 6 (x-axis) are compensated. In consequence of the favorable positioning of the discharge port 8 in the mid-zone of the soleplate 6, the edge 9 of the soleplate 6 is substantially in all points at the same level h in the hovered condition.

For example, the soleplate 6 including the tube 7 is made from plastics, injection-moulder in one piece. In the absence of a heating in the soleplate 6, the soleplate may be designed very thin—preferably 1 to 3 mms. Therefore, the soleplate 6 lends itself to great ease of manufacture at less costs than any conventional ironing sole of an iron. The edge 9 of the soleplate 6 is rounded off to prevent the edge 9 from damaging the textile material, if it impinges on wrinkles 5 standing upright, for example.

Figure 2:
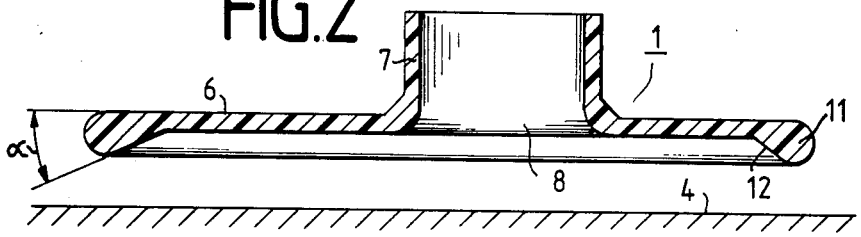
FIG. 2 is a soleplate as displayed in FIG. 1 including a marginal bead.

FIG. 2 shows an ironing device 1 with a soleplate 6 comprising of a preferably circumferential marginal bead 11. For clarity, the fan 2 and the textile material 3 have not been drawn in FIG. 2. The marginal bead 11, too, has rounded-off outer rims in order not to damage upright textile material edges or to better slide across them. In respect of the horizontally aligned soleplate 6, the inner side 12 of the marginal bead 11 is flattened by a downwardly directed angle $\alpha$. By virtue of the marginal bead 11, a space for accumulating the air cushion 10 is created which latter, compared to FIG. 1, is hindered to flow off. In addition, the air cushion 10 flowing off is subjected to a change in direction by the angle $\alpha$ at the inner side 12 of the marginal bead 11, whereby lifting and hovering of the ironing device 1 is favored by those forces resulting from the deflection of the air stream. The accumulated pressure or, respectively, the static pressure will therefore be increased by the marginal bead 11 when comparing with the embodiment of FIG. 1, with the same fan capacity prevailing. In FIG. 2, the edge at the discharge port 8 is rounded off for better and easier deflection of the air stream WL. Likewise, the joint at which the tube 7 is seated on the soleplate 6 is reinforced. Although the soleplate 6 in the embodiments described hereinabove and in those embodiments still to be described hereinbelow extends in large areas in parallel to the base support, it is likewise possible that the soleplate 6 is of curved design. In this case, for instance, the soleplate 6 may be curved concavely.

Figure 3:
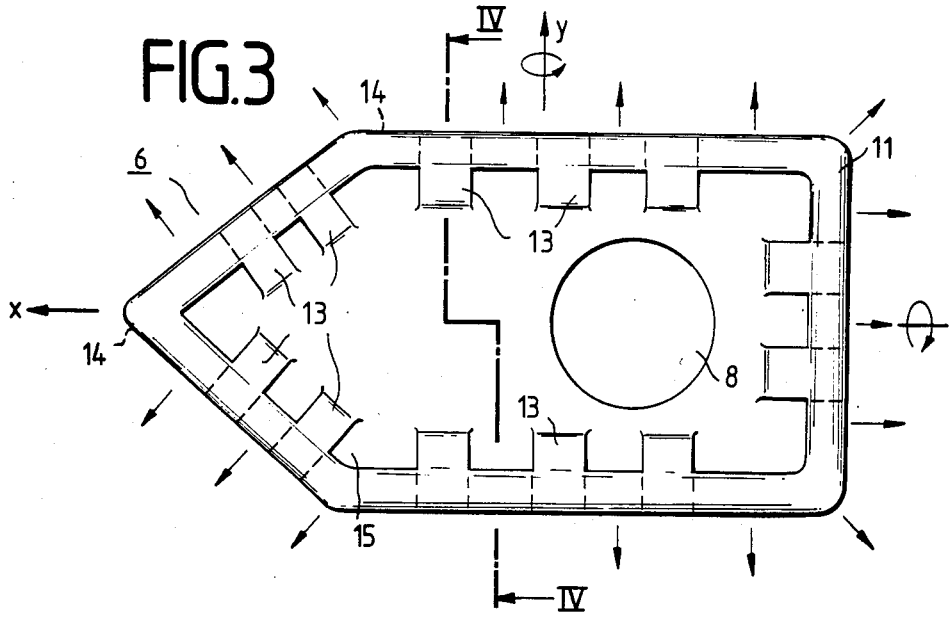
FIG. 3 is a view from below on a soleplate containing apertures in the marginal bead.

FIG. 3 shows the ironing device 1 of FIG. 2 in a view from below. In a known manner, the soleplate 6 has a peak at its front end. The remaining part of the soleplate is of rectangular design in the embodiment shown in FIG. 3. As a variation of FIG. 3, the soleplate 6 may have any other suitable basic form, depending on the case of its application. As is further discernible from FIG. 3, the discharge port 8—as has been described before—is placed on the longitudinal axis of the soleplate 6 (x-axis). The position of the discharge port 8 on the longitudinal axis results from the preceedingly described distribution of weight and the resultant tilting moments about the y-axis shown in FIG. 3. The size of the discharge 8 is conformed to the air passage capacity of the fan 2. In addition to and as a variation of FIG. 2, the marginal bead in FIG. 3 contains apertures 14. By means of these apertures 14, the air discharge at the marginal bead 11 can be conformed to the rate of air flow of the fan 2. Apertures 14 also serve to smooth by blowing larger wrinkles 5 lying in front of the ironing device 1. Besides, these radial apertures 14 are disposed symmetrically in relation to the longitudinal axis of the soleplate 6, one aperture 14 being preferably at the peak of the soleplate 6. The aperture 14 at the peak of the soleplate 6 likewise serves to smooth larger wrinkles 5 which the ironing device 1 is approaching. By designing the apertures 14 in the marginal bead 11, cutout portions will be caused between bead portions 13. These bead portions 13 are also flattened like the inner side 12 of the marginal bead 11 of FIG. 2.

Figure 4:
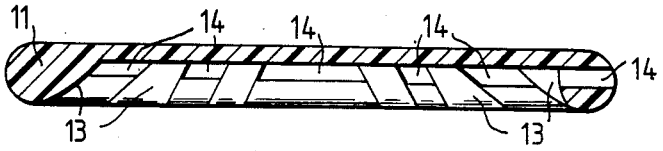
FIG. 4 is a cross-section taken along the line of intersection 4—4 of the soleplate of FIG. 3.

FIG. 4 displays a cross-section through the soleplate 6 of FIG. 3 along the deviated line of intersection 4—4. Beginning in point A, the cross-section extends through the marginal bead 11 including the bead portion 13 with the flattened inner side. On the other side, the cross-section extends through a radial aperture 14 in point B. In the middle of the soleplate 6, the larger aperture 14 disposed on the peak can be seen. If so desired, these apertures 14 may be comb-like cuts in the marginal bead 11. For instance, such comb-like cuts can be designed by sawing into the marginal bead 11 from the bottom side of the soleplate 6. Further, it is possible to furnish in a similar manner the soleplate 6 with bores, out of which the air cushion 10 is partly allowed to exit upwards. The number and size of the bores, slots and apertures 14 permit the selection of the hovering height of the ironing device, with the air passage capacity of the fan 2 being predetermined.

Figure 5:
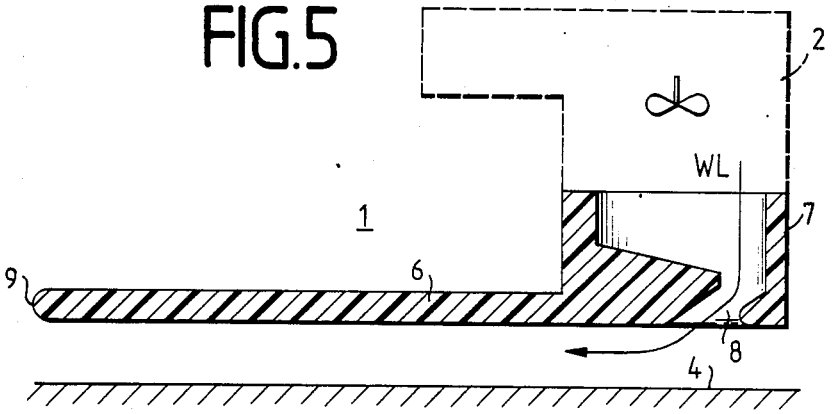
FIG. 5 is a second embodiment of a soleplate according to this invention.

FIG. 5 displays another embodiment of this invention. The ironing device 1 according to FIG. 5 differs from the ironing device according to FIG. 1 in that the discharge port 8 for the air stream is arranged at the edge 9 of the soleplate 6, the flow direction of the air stream pointing underneath the soleplate 6. The textile material 3 is not shown in FIG. 5 for the sake of clarity. The fact that the air stream WL is directed underneath the soleplate 6 results in a very long exhaust path. Therefore, the major part of the air stream WL penetrates in a sufficient velocity of flow the entire soleplate 6 in its longitudinal direction. Although the air stream WL is blown from the edge 9 of the soleplate 6 underneath the soleplate, the total air stream WL will contribute to the development of the air cushion 10. Discharge of the air stream WL beyond the edge 9 without covering a longer flow path underneath the soleplate 6 is prevented by the inward orientation of the angle of discharge. The soleplate 6 may also comprise the marginal bead 11 including the apertures 14 referred to hereinabove. Depending on the case of application, the fan 2 can be in all embodiments a fixedly integrated fan generating hot air, for instance. On the other hand, a great number of advantages and possibilities of applications will arise, if the fan 2 is a hair dryer coupled to the tube 7 via a sealing snap-on coupling. This enables to use the hair dryer, with the aid of the soleplate 6, additionally as an ironing device, what is a special advantage when travelling. Furthermore, it is possible in all embodiments to design guiding webs for the air stream WL on the bottom side of the soleplate 6. In this arrangement, the guiding webs are not shown, they extend vertically to the bottom side of the soleplate 6 and are aligned such that the air stream WL must follow a preferred flow path. For instance, embodiments are conceivable in which guiding channels extend from the discharge port 8 in longitudinal direction of the soleplate 6 on the bottom side thereof. The walls of said guiding channels preferably are not higher than the marginal bead 11, provided there is a like bead. The better distribute the air cushion beneath the soleplate 6, the walls of the guiding channels may contain breaks or may not reach up to the marginal bead 11 directly. The walls of the ducts serve to prevent the air cushion 10 from flowing off sideways (y-direction) too easily. Furthermore, the ironing device 1 floating on the air cushion 10 is given much more stability. That means the ironing device 1 will not automatically change the position it was placed when the fan 2 is running, and the ironing device 1 will not drift away so easily. Likewise, the air cushion will not collapse so quickly, if the soleplate 6 projects laterally beyond an edge. Depending on the case of application, webs extending transversely to the direction of flow may also be provided on the bottom side of the sole-plate 6, the said webs contributing to flow turbulence.

Figure 6:
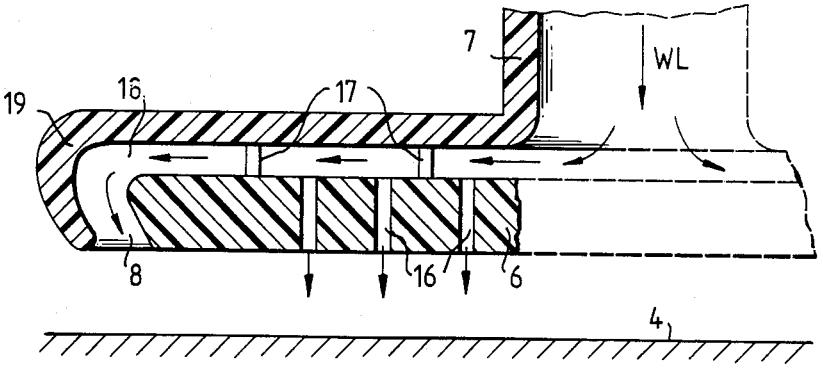
FIG. 6 is a third embodiment of a soleplate according to this invention.

FIG. 6 displays another embodiment, wherein the air stream WL is blown from all sides of the edge beneath the soleplate 6. To this effect, the soleplate 6 is on its upper side connected to an outer wall 19 via retaining webs 17. The height of the retaining webs 17 will so define the height of a duct between the outer wall 19 and the upper side of the soleplate 6. The air stream WL is conveyed via the tube into the duct 18 in which the air stream WL bounces on the upper side of the soleplate 6 and is distributed radially to all sides into the duct 18. After having passed the duct 18, the deflected air stream WL will exit from the discharge port 8 extending at the periphery. The air streams exiting from the discharge port 8 is again directed underneath the soleplate 6. If so desired, single ducts 18 may also extend between the outer wall 19 and the soleplate 6 to discharge ports 8 which are arranged at appropriate locations at the edge of the ironing device 1. It is also possible to furnish the soleplate 6 with bores 16 through which part of the air stream WL is allowed to exit vertically from the soleplate 6.

Besides, it is possible to mount a motion-responsive or a vibration-responsive switch which will detect whether the ironing device is in or out of operation. By means of this switch, the fan 2—when the iron is not used—will be disconnected automatically after a specific period of time. When the ironing device 1 is seized to continue ironing, the switch will detect this movement and lifting of the ironing device 1 from its place of rest and will immediately switch on the fan. Thus, the ironing device 1 is switched on again during that period of time, in which the ironing device is moved from its place of rest towards the material to be ironed. Hence, the ironing device disclosed in the instant invention saves considerably more energy than conventional irons. It is also possible to provide a magnet on the position of rest which will influence a switch in the ironing device when the ironing device 1 is seated on its place of rest. Preferably, this switch that is responsive to the magnitude of the magnetic field is a reed contact which may easily be accommodated and cast in the soleplate 6; for instance. To this end, the resting place for the iron 1 conforms to the soleplate shape, and the magnet is arranged on said rest place so that a reed contact switch will be actuated when the iron is put-down said magnet can be an adhesive coated magnet foil.

We claim:

1. An ironing device for ironing a textile material placed on a base support for use with a hair dryer that provides an air stream that is generated by a fan in the hair dryer and is directed via a duct, said ironing device including soleplate structure with at least one discharge port in said soleplate structure, connecting structure for attachment to the hair dryer so that the hair dryer duct is in communication with said discharge port in the soleplate and the air stream generated by the hair dryer fan flows through the duct is exhausted through said discharge port, and marginal bead structure at the periphery of said soleplate structure, the accumulated pressure of the air stream beneath the soleplate being sufficient to develop a large-surface air cushion between the soleplate and the textile material placed on the base support, said air cushion lifting the ironing device from the textile material and supporting it during the ironing process and the dimensions of said soleplate and the location of said discharge port thereon are such that the lifting forces originating from said air cushion neutralize any tilting moments caused by the rotation of said fan.

2. An ironing device as claimed in claim 1, characterized in that a stream of hot air is used.

3. An ironing device as claimed in claim 1, characterized in that a cold soleplate is used.

4. An ironing device as claimed in claim 1, characterized in that an air stream containing water is used.

5. An ironing device as claimed in claim 1, characterized in that the discharge port for the air stream is located in the mid-zone of the soleplate.

6. An ironing device as claimed in claim 5 wherein the cross sectional area of said discharge port is substantially the same as the cross sectional area of the duct of the hair dryer.

7. An ironing device as claimed in claim 1, characterized in that the discharge port for the air stream is located at the edge of the soleplate.

8. An ironing device as claimed in claims 5 or 7, characterized in that the discharge port is disposed on the longitunal axis (x) of the soleplate.

9. An ironing device as claimed in claims 5 or 7, wherein said hair dryer is adapted to be coupled to the soleplate via a sealing snap-on coupling.

10. An ironing device as claimed in claim 9, characterized in that the soleplace is a flat plate, on the upper side of which a tube is provided for said coupling of the hair dryer.

11. An ironing device as claimed in claims 5 or 7, characterized in that the soleplate is composed of a light weight material such as plastic.

12. An ironing device as claimed in claim 11, characterized in that the soleplate is 1 to 3 mms thick.

13. An ironing device as claimed in claim 1, characterized in that the marginal bead has rounded-off edges.

14. An ironing device as claimed in claim 13, characterized in that the inner side of the marginal bead is flattened.

15. An ironing device as claimed in claim 14, characterized in that the marginal bead contains radial apertures.

16. An ironing device as claimed in claim 15, characterized in that the apertures are arranged symmetrically relative to the longitudinal axis (x) of the soleplate.

* * * * *